US008811634B2

(12) United States Patent
Kaplan et al.

(10) Patent No.: US 8,811,634 B2
(45) Date of Patent: Aug. 19, 2014

(54) DUST PROTECTION APPARATUS FOR FLAT LOUDSPEAKERS

(75) Inventors: Shay Kaplan, Givat Ela (IL); Yuval Cohen, Rehovot (IL); Daniel Lewin, Ramat Hasharon (IL); Meir Ben Simon, Givat Ela (IL)

(73) Assignee: Audio Pixels Ltd., Rehovot, IL (US)

( * ) Notice: Subject to any disclaimer, the term of this patent is extended or adjusted under 35 U.S.C. 154(b) by 36 days.

(21) Appl. No.: 13/265,227

(22) PCT Filed: Apr. 22, 2010

(86) PCT No.: PCT/IL2010/000321
§ 371 (c)(1),
(2), (4) Date: Oct. 19, 2011

(87) PCT Pub. No.: WO2010/122556
PCT Pub. Date: Oct. 28, 2010

(65) Prior Publication Data

US 2012/0033846 A1 Feb. 9, 2012

Related U.S. Application Data

(60) Provisional application No. 61/171,946, filed on Apr. 23, 2009.

(51) Int. Cl.
*H04R 25/00* (2006.01)

(52) U.S. Cl.
USPC ..... 381/189; 381/386

(58) Field of Classification Search
USPC ..... 381/152, 353, 170–181, 184, 186, 381/391–392, 189, 386
See application file for complete search history.

(56) References Cited

U.S. PATENT DOCUMENTS

| | | | | |
|---|---|---|---|---|
| 4,131,363 | A | 12/1978 | Shea et al. | |
| 6,289,106 | B1 | 9/2001 | Wong | |
| 6,975,740 | B2 | 12/2005 | Rautio et al. | |
| 7,016,186 | B2 | 3/2006 | Ueda et al. | |
| 7,286,681 | B2 | 10/2007 | Gerkinsmeyer | |
| 7,434,305 | B2 * | 10/2008 | Minervini | 381/170 |
| 2007/0201715 | A1 | 8/2007 | Minervini | |

FOREIGN PATENT DOCUMENTS

| | | | |
|---|---|---|---|
| EP | 0 317 167 | A1 | 5/1989 |
| EP | 1 933 588 | A1 | 6/2008 |
| GB | 2 064 265 | A | 6/1981 |
| WO | WO 97/45829 | A1 | 12/1997 |

* cited by examiner

*Primary Examiner* — Suhan Ni
(74) *Attorney, Agent, or Firm* — Oliff PLC

(57) ABSTRACT

A method for fabricating flat loudspeakers comprising manufacturing a flat loudspeaker including at least one microspeaker array, having first and second main surfaces; and covering at least one of the main surfaces of the loudspeaker with a cover member including an airtight sound-pressure wave transparent thin polymer film.

27 Claims, 6 Drawing Sheets

DUST PROTECTION APPARATUS FOR FLAT LOUDSPEAKERS

REFERENCE TO CO-PENDING APPLICATIONS

Priority is claimed from U.S. provisional application No. 61/171,946, entitled "Dust protection apparatus for flat digital loudspeakers" and filed 23 Apr. 2009.

Other co-pending applications are:

| Country | Official No. | Title |
|---|---|---|
| USA | 60/802,126 | AN APPARATUS FOR GENERATING PRESSURE |
| USA | 60/907,450 | APPARATUS FOR GENERATING PRESSURE AND METHODS OF MANUFACTURE THEREOF |
| USA | 60/872,488 | VOLUME CONTROL |
| USA | | VOLUME CONTROL |
| PCT | IL2007/000622 | APPARATUS AND METHODS FOR GENERATING PRESSURE WAVES |
| USA | 60/924,203 | APPARATUS AND METHODS FOR GENERATING PRESSURE WAVES |
| USA | | IMPROVED MANUFACTURING |
| PCT | IL2007/000618 | DIRECT DIGITAL SPEAKER APPARATUS HAVING A DESIRED DIRECTIVITY PATTERN |
| PCT | IL2007/000621 | VOLUME AND TONE CONTROL IN DIRECT DIGITAL SPEAKERS |
| USA | 60/996,513 | IMPROVED SPEAKER APPARATUS AND METHODS USEFUL IN CONJUNCTION THEREWITH |
| USA | 61/136,778 | ACTUATOR APPARATUS WITH COMB-DRIVE COMPONENT AND METHODS USEFUL FOR MANUFACTURING AND OPERATING SAME |
| PCT | IL2009/000943 | ACTUATOR APPARATUS WITH COMB-DRIVE COMPONENT AND METHODS USEFUL FOR MANUFACTURING AND OPERATING SAME |
| USA | 61/171,946 | DUST PROTECTION APPARATUS FOR FLAT DIGITAL LOUDSPEAKERS |
| USA | | CORONA DISCHARGE |
| USA | 12/301,954 | VOLUME AND TONE CONTROL IN DIRECT DIGITAL SPEAKERS |
| PCT | IL2008/001524 | DIGITAL SPEAKER APPARATUS |
| USA | 12/301,951 | APPARATUS AND METHODS FOR GENERATING PRESSURE WAVES |
| USA | 12/601,427 | DIRECT DIGITAL SPEAKER APPARATUS HAVING A DESIRED DIRECTIVITY PATTERN |
| USA | 61/312,797 | ELECTROSTATIC PARALLEL PLATE ACTUATORS WHOSE MOVING ELEMENTS ARE DRIVEN ONLY BY ELECTROSTATIC FORCE AND METHODS USEFUL IN CONJUNCTION THEREWITH |

FIELD OF THE INVENTION

The present invention relates generally to micro-actuator arrays and more particularly to flat loudspeakers.

BACKGROUND OF THE INVENTION

Actuator arrays such as flat loudspeakers are known in the art and are described, for example, in the above-referenced co-pending applications.

The disclosures of all publications and patent documents mentioned in the specification, and of the publications and patent documents cited therein directly or indirectly, are hereby incorporated by reference.

SUMMARY OF THE INVENTION

Certain embodiments of the present invention seek to provide a cover for arrays of flat actuators protecting the flat actuator arrays from dust and other particles.

There is thus provided, in accordance with at least one embodiment of the present invention, dust protection cover apparatus for flat loudspeakers comprising a cover member including an airtight sound-pressure wave transparent thin polymer film.

Further in accordance with at least one embodiment of the present invention, the thickness of the film is less than 10 microns thick.

Still further in accordance with at least one embodiment of the present invention, the thickness of the film is of an order of magnitude of 2 microns thick.

Still further in accordance with at least one embodiment of the present invention, the polymer is selected from the following group: Nitrocellulose, Polyimide, Polyethylene, Polyester, Parylene.

Also in accordance with at least one embodiment of the present invention, the apparatus also comprises a flat loudspeaker, at least a portion of which engages the sound-pressure wave transparent thin polymer film.

Further in accordance with at least one embodiment of the present invention, the sound-pressure wave transparent thin polymer film is attached via an adhesive to the portion.

Additionally in accordance with at least one embodiment of the present invention, the sound-pressure wave transparent thin polymer film is thermally bonded to the portion.

Further in accordance with at least one embodiment of the present invention, the sound-pressure wave transparent thin polymer film is ultrasonically welded to the portion.

Still further in accordance with at least one embodiment of the present invention, the sound-pressure wave transparent thin polymer film is laser welded to the portion.

Also provided, in accordance with at least one embodiment of the present invention, is a method for fabricating flat loudspeakers comprising manufacturing a flat loudspeaker having first and second main surfaces; and covering at least one of the main surfaces of the loudspeaker with a cover member including an airtight sound-pressure wave transparent thin polymer film.

Further in accordance with at least one embodiment of the present invention, the covering comprises adhesively attaching a sound-pressure wave transparent thin polymer film to the loudspeaker.

Still further in accordance with at least one embodiment of the present invention, the loudspeaker includes a plurality of speaker element arrays on a substrate; and wherein the covering comprises surrounding the loudspeaker with at least one frame; and mounting a sound-pressure wave transparent thin polymer film onto the frame.

Additionally in accordance with at least one embodiment of the present invention, the mounting is performed before the surrounding by pre-mounting the film onto the at least one frame.

Further in accordance with at least one embodiment of the present invention, the loudspeaker has at least one recess for controlling the flow of an adhesive used to attach the film to the portion.

Still further in accordance with at least one embodiment of the present invention, the sound-pressure wave transparent thin polymer film is attached to both top and bottom surfaces of the flat loudspeaker.

Additionally in accordance with at least one embodiment of the present invention, the frame has two main sides and is operative to equalize pressure between its two main sides.

Still further in accordance with at least one embodiment of the present invention, the pressure is equalized by the frame having vent holes connecting the two sides of the frame.

Further in accordance with at least one embodiment of the present invention, the holes contain a porous material.

Still further in accordance with at least one embodiment of the present invention, the pressure is equalized by the frame having on at least one of its surfaces a groove allowing air transfer from one side of the frame to the other.

Further in accordance with at least one embodiment of the present invention, the groove comprises a meandering groove.

Still further in accordance with at least one embodiment of the present invention, the pressure is equalized by the frame attached such that the frame includes a wall disposed over a groove formed in the surface to which the frame is attached allowing air transfer from one side of the frame to the other.

Further in accordance with at least one embodiment of the present invention, the apparatus also comprises a flat loudspeaker including a plurality of speaker element arrays covered by the cover member.

Still further in accordance with at least one embodiment of the present invention, the adhesive is porous and allows air to flow through it.

Further in accordance with at least one embodiment of the present invention, the film is mounted onto the at least one frame using adhesive.

Further in accordance with at least one embodiment of the present invention, the frame is an integral part of the substrate onto which at least one array is attached.

Further in accordance with at least one embodiment of the present invention, the frame and film also cover at least one electrical connection connecting the substrate to at least one array.

Still further in accordance with at least one embodiment of the present invention, the film is made from a polymer able to withstand temperatures used during solder reflow such as polyimide.

Further in accordance with at least one embodiment of the present invention, the flat loudspeaker surface is treated to become hydrophobic.

Additionally in accordance with at least one embodiment of the present invention, the frame's surface is treated to become hydrophilic.

The embodiments referred to above, and other embodiments, are described in detail in the next section.

Any trademark occurring in the text or drawings is the property of its owner and occurs herein merely to explain or illustrate one example of how an embodiment of the invention may be implemented.

BRIEF DESCRIPTION OF THE DRAWINGS

Certain embodiments of the present invention are illustrated in the following drawings.

DETAILED DESCRIPTION OF CERTAIN EMBODIMENTS

Figure 1A:
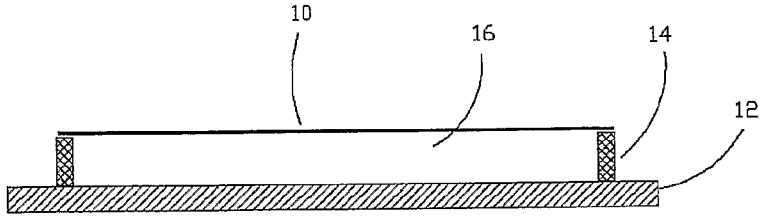
FIG. 1A is a side cross-sectional view of a frame with film attached directly to the speaker surface.

Flat digital loudspeakers typically comprise an array of multiple (e.g. 10 or 100) microspeaker elements or multiple such arrays attached to a common substrate. Unlike traditional speakers (the terms "loudspeaker" and "speaker" are used herein interchangeably) where the gap in which the coil moves has to be protected only from particles that can interfere with the coil's free movement, the microspeakers are usually very sensitive to particulate contamination, even from sub-micron size particles. Also, the whole area has to be protected from dust while letting the sound pressure waves pass through the dust barrier.

A "flat" loudspeaker refers to a generally two-dimensional loudspeaker in which the thickness to diameter or hypotenuse ratio is less than 0.2.

In traditional loudspeakers, dust protection is provided by a dust cap or dust cone (U.S. Pat. No. 7,286,681) to protect the sensitive areas. Sometime a dust screen or mesh is used but these do not always let sound pass through them and they themselves sometimes actually move with the diaphragm and take part in the sound generation (U.S. Pat. No. 6,975,740). Sometimes a dust screen or mesh is used but their holes are very large as to let the air move through them (U.S. Pat. No. 7,016,186, U.S. Pat. No. 6,289,106).

Certain embodiments of the present invention seek to provide use of a thin (e.g. 2-10 microns), low-density (e.g. formed of polymer), airtight film as a dust barrier. The barrier can be applied directly on the speaker, surface or slightly above it. The film is typically so thin (sub micron to several microns thick) that it cannot absorb the sound energy and transmits sound at frequencies covering the audible spectrum to typically over 50 KHz with a loss of typically less than 2 dB.

These films may be similar to photomask pellicles (U.S. Pat. No. 4,131,363) e.g. as distributed by Micro Lithography, Inc. (MLI) 1257 Elko Drive Sunnyvale, Calif. 94089, or other thin polymer films such as Mylar™, Prolene™ and Etnom™ available from Chemplex, Palm City, Fla., USA; or polyimide available from Dupont de Namur under the name Kapton™; these are sometimes referred to as ultrathin films. The film may be attached directly to the speaker surface, using adhesive, ultrasonic welding, laser welding, thermal welding or other methods as known in the art or may be mounted offset from the surface e.g. using a spacer frame or a double sided adhesive as a spacer. The film material may be chosen (i.e. Polyimide) for its high temperature resistance allowing a solder reflow process to be used for electrically connecting the loudspeaker to the outside world.

A loudspeaker may comprise one or more speaker elements working together, each of the loudspeaker elements comprising an array of multiple microspeakers.

A plurality of films may each cover only a portion of an individual speaker element thus protecting, in combination, the whole array element, or a single piece of film may cover the whole speaker element, or a single piece of film may cover several arrays on a common substrate that may comprise a speaker system or subsystem. The films may be deployed on either the top side or bottom side of the speaker elements or on both sides.

The films may be coated with thin layers of materials (e.g. fluorocarbons) or treated using processes (e.g. self assembled mono-layers or monolayer vapor deposition) that lower the surface energy or enable static charge dissipation and thus reduce the attraction of dust particles to the film.

The film or its frame may be attached to the speaker surface to allow for adhesive placement. The adhesive may for example be a heat curing, light curing, or chemical curing adhesive or physical adhesives similar to the commercially available double sided adhesive tapes such as those distributed by 3M Israel, Herzlia, Israel, under catalog number 9460.

Since the films are airtight, there may be a need to equalize the pressure between the outside environment and the speaker. This can be achieved by using vent holes in the frame. A dust filter e.g. acrylic foam may be deployed inside these vent holes to filter dust out of incoming air. According to a second embodiment, the holes may be of submicron size or the frame may be made of porous material, such as porous polyurethane, so as not to let airborne particles larger than a few microns pass through the holes. According to a third embodiment, the adhesive layer used for attaching the film, or the film frame if provided, may have submicron pores and may for example comprise acrylic foam tape 4936 available from 3M Israel, Herzlia, Israel, thereby allowing air to move across the film and/or film frame and to block the dust particles. According to a fourth embodiment, which may also employ 3M's acrylic foam tape 4936, the frame surface may have one or more meandering channels crossing from the outside to the inside of the frame allowing air to pass from one side of the frame to the other while preventing movement of most particulates into the protected area which is defined by the film and within which the speaker resides.

A plurality of films on frames or spacers may each cover only a portion of the speaker element thus protecting, in combination, the whole array element, or a single frame or spacer with film may cover the whole speaker element, or a single piece of film on a frame or spacer may cover several arrays on a common substrate that may comprise a speaker system or subsystem. The frames or spacers may be used on either the top side or bottom side of the speaker elements or on both sides as appropriate.

In order to reduce problems associated with humidity condensation on the microspeakers when moved from a high humidity warm environment to a cold environment, the microspeaker element array surface may be treated, e.g. by providing a surface assembled monolayer of Hexamethyldisilazine or other compounds, to become highly hydrophobic, and the frame walls treated to become hydrophilic, for example by exposing them to oxygen plasma, thus enhancing condensation on the frame walls and limiting the condensation on the microspeakers into micro droplets, not large enough to cause any functionality problems.

Referring now to FIGS. 1A-10, FIG. 1A shows an embodiment of the present invention including a speaker and associated protective film where a frame 14 is attached to a main surface 12 of a generally flat loudspeaker element. The polymer film 10 is attached on top of a frame, usually rectangular in shape and having mm sized height and wall thickness. The frame may be made of metal such as aluminum or of a tough polymer material such as an epoxy compound, leaving a space 16 of suitable dimensions between the loudspeaker surface 12 and the film.

Figure 1B:
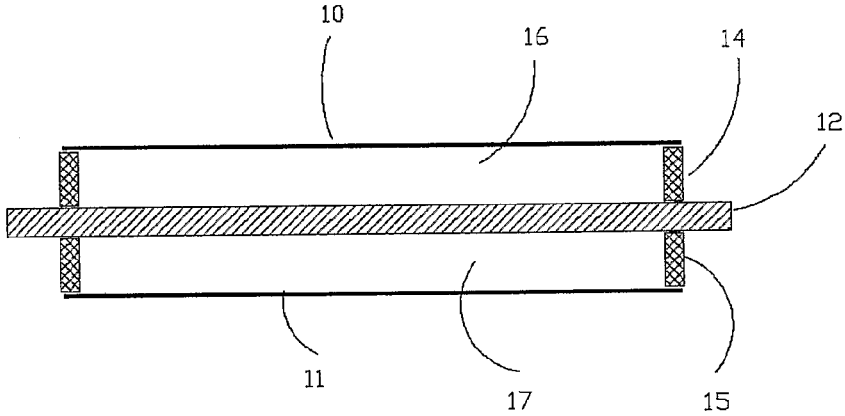
FIG. 1B is a side cross-sectional view of a frame with film attached directly to both top and bottom surfaces of the speaker.
Figure 2:
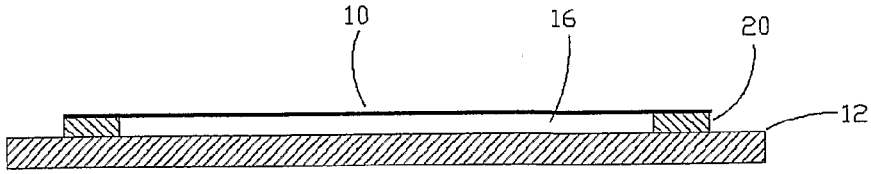
FIG. 2 is a side cross-sectional view of a film attached directly to a speaker using an adhesive layer or double sided adhesive foam strip.

FIG. 1B shows another embodiment of the present invention including a speaker and associated protective film where a frame 14 is attached to a main surface 12 of a generally flat loudspeaker element. The polymer film 10 is attached on top of a frame 14, leaving a space 16 between the loudspeaker surface 12 and the film. The bottom surface 13 of the flat loudspeaker also has associated protective film where a frame 15 is attached to a bottom surface 13 of a generally flat loudspeaker element. The polymer film 11 is attached onto the frame 15, leaving a space 17 between the loudspeaker surface 13 and the film 11. FIG. 2 shows another embodiment of the present invention where the film 10 is attached to the loudspeaker surface 12 using a spacer 20 with adhesive surfaces leaving a space 16 between the loudspeaker surface and the film. This spacer may be formed of foam or other porous material, which allows air pass through while preventing most dust particles from passing through, such as 3M's acrylic foam tape 4936.

Figure 3:
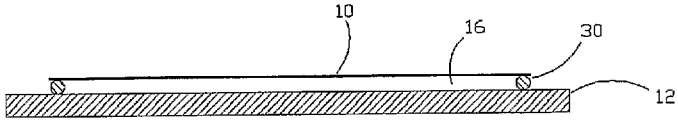
FIG. 3 is a side cross-sectional view of a film attached directly to a speaker by depositing lines of adhesive on the speaker surface.
Figure 4:
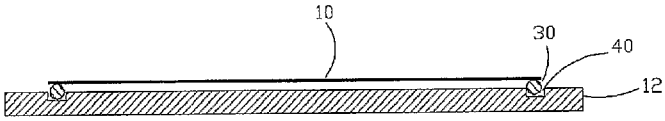
FIG. 4 is a side cross-sectional view of a film attached directly to a speaker using adhesive lines that are placed in at least one pre-manufactured groove or recess in the speaker surface eliminating the risk of excess adhesive flow onto the loudspeaker surface.

FIG. 3 shows an embodiment of the present invention where the polymer film 10 is attached to the surface of the loudspeaker 12 using lines of adhesive 30. The adhesive properties, thickness and the attachment process parameters define the dimensions of the space 16 separating the loudspeaker surface and the film 22 such that the adhesive serves as a spacer. In FIG. 4, the adhesive layer 30 is dispensed into a predefined groove 40 on the surface of loudspeaker 12. The groove typically defines enough free volume to contain any excess adhesive so as to eliminate flow of adhesive onto the loudspeaker surface by allowing the excess adhesive to flow in the groove.

Figure 5:
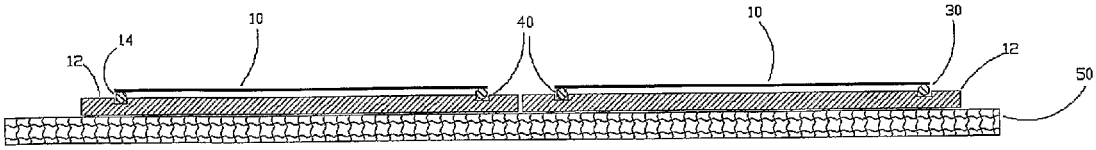
FIG. 5 is a side cross-sectional view of two speaker elements, each protected by a separate film e.g. as in FIGS. 1-4, and both mounted on a single common substrate.

FIG. 5 shows yet another embodiment of the current invention where two loudspeakers as shown in FIG. 4 are mounted on a common substrate 50 such as for example an FR4 based PCB substrate. The substrate may have provisions for supplying electrical signals to the proximity of the loudspeakers.

Figure 6:
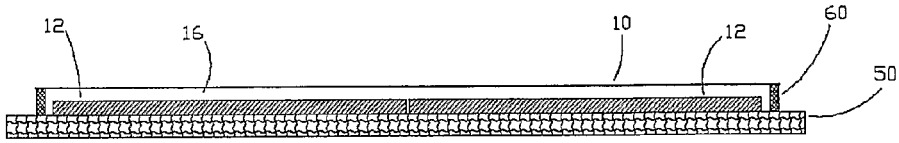
FIG. 6 is a side cross-sectional view of two speaker elements, mounted on a common substrate with a frame and film protecting both speaker elements.

FIG. 6 shows an additional embodiment of the current invention where two loud speaker elements 12 are attached to a common substrate 50, where the substrate may have provisions for supplying electrical signals to the proximity of the loudspeakers. A frame 60 is attached to the common substrate 50 and a protecting thin polymer film 10 is attached on top of the frame 60. The frame 60 may also be an integral part of the common substrate 50, both being manufactured as a single part.

Figure 7:
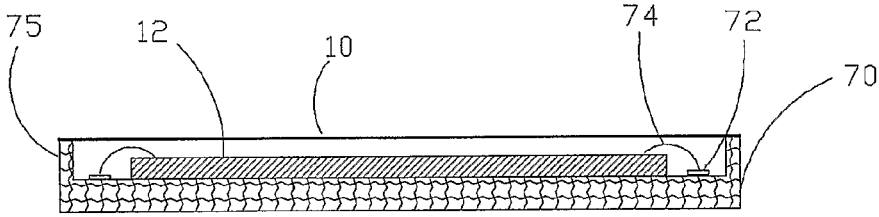
FIG. 7 is a side cross-sectional view of a single speaker mounted in a substrate that has a pre-manufactured frame for film attachment, pads for electrical connections, electrical connections from the speaker to the pads and a protective film.
Figures 8A, 8B:
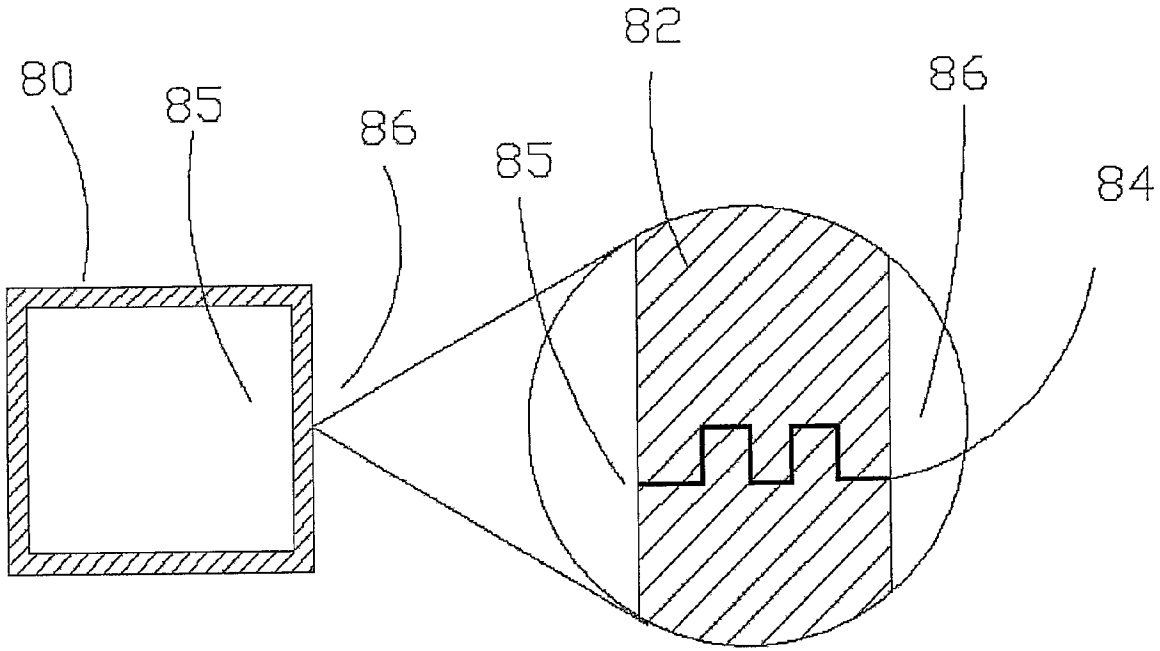
FIG. 8A is a bottom view of a frame including a part, magnified in FIG. 8B, containing a typically meandering opening, which may for example be less than <500u deep and which serves as an air pass through preventing particles from moving inside the cavity or space sealed by the frame, the film and the substrate or speaker surface.
FIG. 8B shows a enlarged detail of FIG. 8A.

FIG. 7 shows an embodiment of the present invention wherein the frame and film cover not only the array but also the electrical connections connecting the substrate to at least one array. As shown, a loudspeaker 12 is attached to a substrate 70 having an integral film support frame portion 75 and electrical pads 72. The pads 72 are connected to the outside of the substrate or to other electronic components that are included in the substrate (not shown). The pads enable electrical connection of the loudspeaker 12 to the substrate 70. The protective polymer film 10 is attached to the frame portion after the wiring of the loudspeaker 12. The wiring shown here represents wire bonding technology but it is appreciated that other techniques known in the art for silicon die electrical connection, such as bumping, flip chip or other methods, may be used. FIGS. 8A-8B illustrate yet another embodiment of the present invention where the frame 80 onto which the film (not shown) is attached includes one or more straight or meandering grooves. In the illustrated embodiment, as shown in the enlarged bubble of FIG. 8B, a meandering groove 84 is provided on the bottom surface 82 of the frame that is later attached to the surface of the loudspeaker or the substrate, that blocks most airborne particles from entering the volume protected by the film while letting air flow in and out thus allowing for pressure equalization between the protected volume 85 and the outside environment 86. It should be appreciated that the embodiment is also applicable where a spacer acts as a frame and is mounted on the substrate or directly over the loudspeaker element surface.

Figures 9A, 9B:
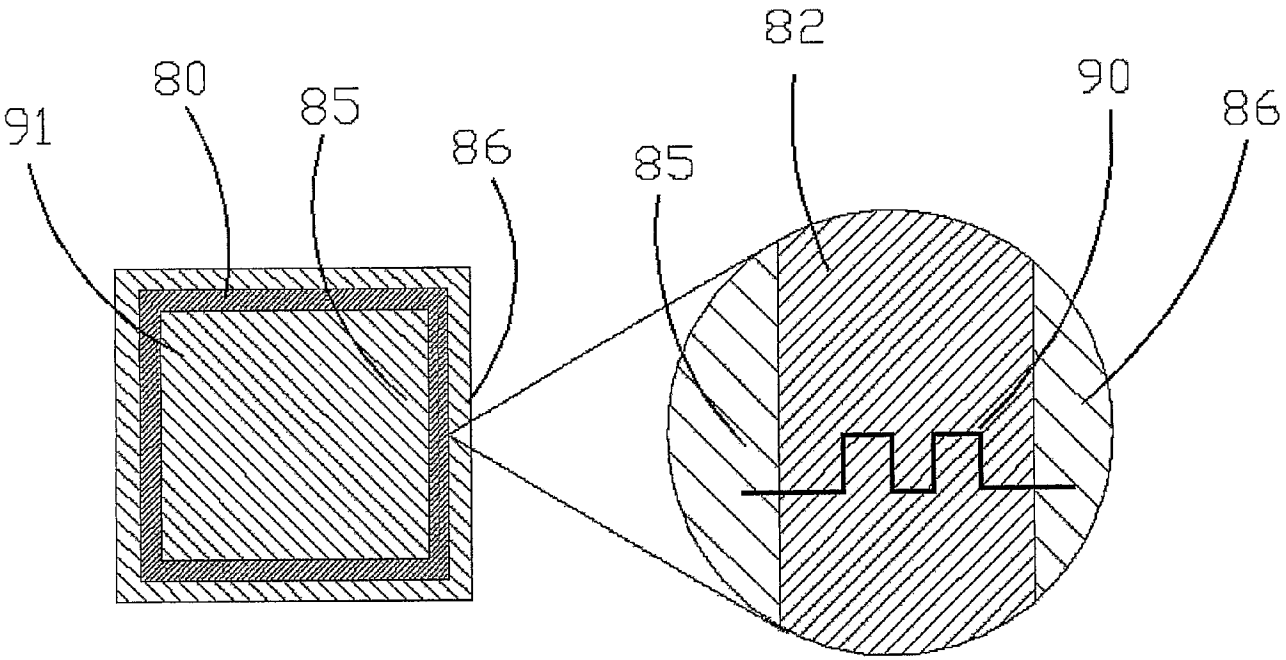
FIG. 9A is a top view of a frame including a part, magnified in FIG. 9B, containing a meandering opening on the surface onto which the frame is attached that serves as an air pass through that prevents particles from moving into the cavity or space sealed by the frame, the film and the substrate or speaker surface.
FIG. 9B shows a enlarged detail of FIG. 9A.

FIGS. 9A-9B illustrate yet another embodiment of the present invention where the surface 91 onto which the frame 80 is attached, has one or more grooves. As best seen in the enlarged bubble of FIG. 9B, a meandering groove 90 may be provided which blocks most airborne particles from entering the volume protected by the film while letting air flow under the frame in and out thus allowing for pressure equalization between the protected volume 85 and the outside environment 86. It should be appreciated that the embodiment is also applicable where a spacer acts as a frame and is mounted on the substrate or directly over the loudspeaker element surface. It should be mentioned that in FIG. 9B, for explanatory purposes, the groove 90 is shown through the frame 80 when viewing from the top although of course, in practice, frame 80 need not be formed from a transparent material.

Figure 10:
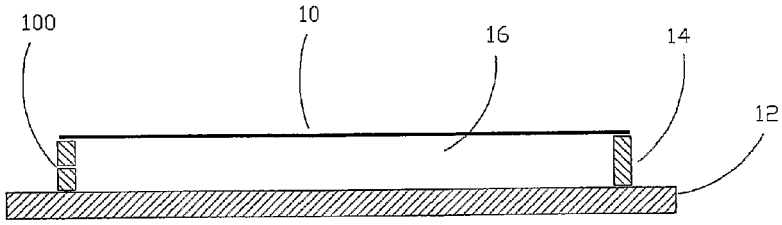
FIG. 10 is a side cross-sectional view of a frame with film attached directly to the speaker surface where the frame has one or more vent holes allowing air to pass from one side of the frame to the other.

As shown, pressure is equalized by the frame 80 being attached such that its wall 82 is disposed over the groove 90 formed in the surface to which frame 80 is attached, thereby allowing air transfer from one side of the frame, 85, to the other side 86 of the frame. FIG. 10 shows an embodiment of the present invention including a speaker and associated protective film where a frame 14 is attached to a main surface 12 of a generally flat loudspeaker element. The polymer film 10 is attached on top of a frame 14 that has a vent hole 100 that allows for air to move from one side of the frame to the other, leaving a space 16 between the loudspeaker surface 12 and the film. The vent hole may have a porous material such as an acrylic foam, not shown, that acts as an airborne particle filter. It is appreciated that the applicability of the invention shown and described herein is not limited to digital loudspeakers and instead is also applicable for analog loudspeakers comprising one or more arrays of microspeakers.

It is appreciated that terminology such as "mandatory", "required", "need" and "must" refer to implementation choices made within the context of a particular implementation or application described herewithin for clarity and are not intended to be limiting since in an alternative implantation, the same elements might be defined as not mandatory and not required or might even be eliminated altogether.

Features of the present invention which are described in the context of separate embodiments may also be provided in combination in a single embodiment. Conversely, features of the invention, including method steps, which are described for brevity in the context of a single embodiment or in a certain order may be provided separately or in any suitable subcombination or in a different order. "e.g." is used herein in the sense of a specific example which is not intended to be limiting. It is appreciated that in the description and drawings shown and described herein, functionalities described or illustrated as systems and sub-units thereof can also be provided as methods and steps therewithin, and functionalities described or illustrated as methods and steps therewithin can also be provided as systems and sub-units thereof. The scale used to illustrate various elements in the drawings is merely exemplary and/or appropriate for clarity of presentation and is not intended to be limiting.

The embodiments of the present invention include but are not limited to those set out in the following claims.

The invention claimed is:

1. A system including a flat loudspeaker including at least one microspeaker array and a dust protection cover apparatus, the dust protection cover apparatus comprising:

a cover member including an airtight sound-pressure wave transparent thin polymer film, wherein the thickness of the film is between 0.1 microns and 10 microns thick so that it cannot absorb energy and transmits sound at frequencies from 20 Hz to 100 kHz and the film covers substantially the whole area of the at least one microspeaker array.

2. System according to claim 1 wherein said loudspeaker includes a plurality of speaker element arrays on a substrate; and wherein the loudspeaker is surrounded with at least one frame on which the sound-pressure wave transparent thin polymer film is mounted, and wherein said frame has two main sides and is operative to equalize pressure between its said two main sides.

3. System according to claim 2 and wherein pressure equalization is achieved by using vent holes in the frame.

4. System according to claim 3 wherein a dust filter is deployed inside said vent holes to filter dust out of incoming air.

5. System according to claim 1 wherein the thickness of the film is of an order of magnitude of 2 microns.

6. System according to claim 1 wherein said polymer is selected from the following group: Nitrocellulose, Polyimide, Polyethylene, Polyester, Parylene.

7. System according to claim 1 wherein the film is mounted offset from the surface using a spacer frame.

8. System according to claim 7 wherein said sound-pressure wave transparent thin polymer film is attached via an adhesive to said frame.

9. System according to claim 8 wherein said loudspeaker has at least one recess for controlling the flow of an adhesive used to attach said film to said frame.

10. System according to claim 7 wherein said pressure is equalized by said frame having on at least one of its surfaces a groove allowing air transfer from one side of the frame to the other.

11. System according to claim 10 wherein said groove comprises a meandering groove.

12. System according to claim 8 wherein said adhesive is porous and allows air to flow through it.

13. System according to claim 7 wherein said sound-pressure wave transparent thin polymer film is thermally bonded to said frame.

14. System according to claim 7 wherein said sound-pressure wave transparent thin polymer film is ultrasonically welded to said frame.

15. System according to claim 7 wherein said sound-pressure wave transparent thin polymer film is laser welded to said frame.

16. System according to claim 7 wherein said pressure is equalized by said frame such that said frame includes a wall disposed over a groove formed in the surface to which said frame is attached allowing air transfer from one side of the frame to the other.

17. System according to claim 7 and wherein pressure equalization is achieved by forming the frame of porous material defining holes, so as not to let airborne particles larger than a few microns pass through the holes.

18. System according to claim 7 wherein said frame has two main sides and wherein said pressure is equalized by said frame having vent holes connecting said two sides of said frame.

19. System according to claim 18 wherein said holes contain a porous material.

20. System according to claim 1 wherein said film is made from a polymer able to withstand temperatures used during solder reflow.

21. System according to claim 1 wherein said flat loudspeaker surface is treated to become hydrophobic.

22. System according to claim 1 wherein said loudspeaker includes a plurality of speaker element arrays.

23. System according to claim 1 wherein said sound-pressure wave transparent thin polymer film is attached to both top and bottom surfaces of said flat loudspeaker.

24. System according to claim 1 and also comprising a flat loudspeaker including at least one microspeaker array which is covered by said cover member.

25. System according to claim 1 wherein the film is mounted offset from the surface using a spacer frame and wherein pressure equalization is achieved by using a frame whose surface has at least one meandering channels crossing from the outside to the inside of the frame.

26. System according to claim 1 wherein said loudspeaker includes a plurality of speaker element arrays on a substrate; and wherein loudspeaker is surrounded with at least one frame on which the sound-pressure wave transparent thin polymer film is mounted, and wherein said frame is an integral part of said substrate onto which at least one said array is attached.

27. System according to claim 26 wherein said frame and film also cover at least one electrical connection connecting said substrate to at least one said array.

* * * * *